United States Patent [19]

Potter

[11] Patent Number: 4,658,454

[45] Date of Patent: Apr. 21, 1987

[54] TOP AND BOTTOM BEDSHEET COMBINATION NONCONFINING TO THE FEET OF A TALL PERSON

[76] Inventor: Wilson Potter, P.O. Box 1672, Lake Havasu City, Ariz. 86403

[21] Appl. No.: 649,930

[22] Filed: Sep. 13, 1984

[51] Int. Cl.[4] ..... A47G 9/02

[52] U.S. Cl. ..... 5/497; 5/500

[58] Field of Search ..... 5/497, 496, 495, 498, 5/482, 500, 502, 485

[56] References Cited

U.S. PATENT DOCUMENTS

| | | | |
|---|---|---|---|
| 924,733 | 6/1909 | Carswell . | |
| 1,865,329 | 6/1932 | McHorter . | |
| 2,559,627 | 10/1951 | Black . | |
| 2,679,056 | 5/1954 | Simpson | 5/497 |
| 2,695,414 | 11/1954 | Ford et al. | 5/497 |
| 2,789,292 | 4/1957 | Budinquest | 5/496 |
| 2,994,094 | 8/1961 | Hester . | |
| 3,179,958 | 4/1965 | Carris | 5/496 |
| 3,254,348 | 6/1966 | Di Addario | 5/497 |
| 3,832,743 | 9/1974 | Smith | 5/496 |
| 3,996,633 | 12/1976 | Burke | 5/497 |
| 4,035,854 | 7/1977 | Pardee | 5/497 |
| 4,344,196 | 8/1982 | Large | 5/496 |

*Primary Examiner*—Alexander Grosz

*Attorney, Agent, or Firm*—Emmette R. Holman

[57] ABSTRACT

In a combination of a top bedsheet with a bottom bedsheet that is fitted to a mattress, the improvement consists of providing a row of at least 3 buttons uniformly spaced along the foot end, plus one additional button on each side spaced about 12 inches from the foot end. All buttons are aligned with the bottom-perimeter edge of the mattress and are sewn to the bottom bed sheet. The top bed sheet is provided with a row of buttonholes in the bottom hem, appropriately disposed to engage corresponding buttons of the bottom sheet. For waterbeds, where the bottom bedsheet customarily is provided with 4 triangular corner pockets to receive the 4 corners of the mattress, a row of buttons is sewn to that portion of the foot end hem which is confined between the two corner pockets. The buttons may be sewn through reinforcing strips and tabs.

4 Claims, 7 Drawing Figures

TOP AND BOTTOM BEDSHEET COMBINATION NONCONFINING TO THE FEET OF A TALL PERSON

BACKGROUND OF THE INVENTION

This invention relates to an improvement in the combination of a top bedsheet and a bottom bedsheet, wherein the bottom bedsheet is of the type known in the trade as a "fitted bedsheet" and, wherein the top bedsheet is non-confining to the feet of the occupant, particularly to those of a tall person whose feet may extend beyond the foot end of the mattress.

As used hereinafter for the purpose of this disclosure, the term "fitted bottom bedsheet" applies to a bottom bedsheet which is dimensionally fitted to the mattress, with all four corners closed by a sewn corner seam, the fabric wrapping completely around all four sides of the top and bottom perimeters of the mattress and reaching inwardly, beneath the mattress for a distance of about 1½ inches, or more, there terminating in four free edges bounding a rectangle the sides of which are hereinafter designated as the two side free edges, the head end free edge and the foot end free edge.

At least two opposed free edges of the rectangle are elasticized, for example, as is taught by Henry G. Hester in U.S. Pat. No. 2,994,094. Preferably all four free edges are elasticized as is taught by Morris B. Black in U.S. Pat. No. 2,569,627. It is essential that the bottom bedsheet grasp the mattress sufficiently to preventing slippage in any direction and that it reach under the mattress to prevent vertical liftoff at least at the foot end. The elastization of the free edge is an added convenience in the making up of the bed as is well understood in the trade.

One element of the improvement of this invention consists of providing in the bottom bedsheet, in alignment with the bottom perimeter, a plurality of at least 3, preferably 5, equally-spaced buttons along the foot end plus one additional button on each side, spaced about 12 inches from the foot end corner seam.

The improved top bedsheet of this combination is the customary rectangular bedsheet, preferably hemmed at the head- and foot-ends. Buttonholes are provided in the foot end hem which are appropriately disposed to engage the corresponding buttons of the bottom bedsheet. Extra long top bedsheets are required to accommodate an extra tall person, in which case, the head end of the top bedsheet is aligned with the headboard in the usual fashion and the surplus length of fabric is allowed to drape over the foot end of the mattress in a neat-appearing closed loop. At the corners the surplus material can be neatly tucked under the overhanging side edges. This improved combination provides a non-drafty, extendable, conformable pocket for the feet of the occupant. This pocket is non-confining but, nevertheless, remains in position relative to the mattress, despite the kicking movements of a restless sleeper, and it cannot slide off of the bed.

The following patents are cited herein as having some relevance to the background of this invention: U.S. Pat. Nos. 924,733, 6/15/1909, E. R. Carswell, Sr.; 1,865,329, 6/28/32, Evelyn McHorter; 2,151,375, 3/21/39, Adaline Rose De Voe; 2,462,156, 2/22/49, Bertha Berman; 2,569,627, 10/2/51, Morris B. Black; 2,695,414, 11/30/54, Jesse A. Ford, et al; 2,789,292, 8/23/57, Jane C. Budenquist; 2,972,756, 2/28/61, Albert Monier, et al; 2,994,094, 8/1/61, Henry G. Hester; 3,066,323, 12/4/62, Mildred M. Kintner; 3,606,622, 9/21/71, William K. Williams, et al; 3,111,688, 11/26/63, Annette F. Barnes.

Carswell diagnosed the bedding problem as the tendency of the bottom bedsheet to slide down toward the foot end and the tendency of the top bedsheet to pull up toward the head end. In U.S. Pat. No. 924,733 he offered as a solution to the problem, top- and bottom-bedsheets of identical construction, interchangeable, namely, having one end of sewn boxed construction and adapted to telescopically engage a corresponding end of the mattress. The bottom bed sheet engages the head end; the top bedsheet engages the foot of the mattress.

McHorter, on the other hand, diagnosed the slippage problem as being confined to the foot end for both top- and bottom-bedsheets and, in U.S. Pat. No. 1,865,329, offered her solution to the problem. This consisted, in effect, of employing a bottom bedsheet of the Carswell construction to engage the foot end of the mattress. The top bedsheet is rectangular, with a large square cut away out of each of the two foot end corners. The residual central tab at the foot end has a free edge which is sewn to the free edge of the bottom bedsheet, or alternately, the top- and bottom-bedsheets are made in one piece. The area of fabric which is tucked under the mattress is in duplicate, which is an unnecessary waste of material. This combination, when stretched out, is at least 15 feet long, which is difficult to handle without assistance of a second person, difficult to launder, to dry and to fold, or to make up the bed in a typical size bedroom. Another disadvantage of this one piece construction is that the top- and bottom-bedsheets, which do not wear out at the same time, must be replaced as a one piece combination at the same time with one component thereof still in good, serviceable condition.

Top bedsheets employing the Carswell type pocket for receiving the foot end of the mattress are also utilized in one of the embodiments of the McHorter patent, in De Voe and in Ford. With the exception of Ford, no space is provided within the pocket for the feet of the sleeper, and hence such versions are unsuitable for persons whose feet extend to or into the pocket zone. Ford represents the only case where consideration was given specifically to provide additional space in the pocket for the feet. In the case of Ford, however, the dimensions and location of the peak of the foot cavity are custom tailored to the individual sleeper; the foot cavity is fixed and does not move to accommodate variations in positions of the feet. Illustrated in the Ford patent, for example, is the case for an individual with toes in alignment with the foot end of the mattress. The same individual, turned over on one side and with legs slightly bent at the hips and/or at the knees, would encounter bedsheet pressure on the feet which are now drawn up out of the enlargement provided for his feet.

The Carswell type pocket is difficult to pull over the foot end of a mattress without the assistance of a second person. The Ford patent was the last cited reference to use it. This construction has been superseded by the fitted bottom bedsheet as is best represented by the Black patent, and by its variation, as in the Hester and the Harnes patents, all of which extend around the bottom perimeter of the mattress and have at least a portion of the bottom free edge elasticized. As already mentioned, it is essential for vertical security in the present invention that the bottom free edge extend under and around the bottom perimeter of the mattress, whereby its vertical uplift at the foot end is prevented.

Bottom bedsheet construction, which grasps the sides of the mattress but does not extend under and around its bottom perimeter is utilized in the patents of Berman, Monier and Kintner, all of which are cited herein. The Deutsch patent discloses a bed cover which grasps the two corners at the foot end of the mattress and of the supporting bed spring box as well. The vertical security of this type of construction is inadequate for the purposes of this invention.

Button fasteners are relatively rarely used in the prior art. The Budinquest patent teaches the use of buttons along the two sides and the foot end of the top perimeter of a frame surrounding a crib mattress for holding down the top bedsheet or blanket. This construction is too confining for adult use and the frame is inconvenient to apply to an adult size mattress. Using the buttons only on the foot end of the frame and omitting the buttons on the two sides would provide the desired looseness in the top bedsheet and therewith a pocket for the feet of a tall person, but the buttons protruding from the top of the frame would irritate the feet and cause discomfort. Inverting the frame so that the buttons would face down against the bedspring box would eliminate that cause of discomfort but would aggravate the inconvenience of servicing the bedding.

Alternative fasteners to the sewed on button are the double button in the Monier patent, the hook-and-loop (VELCRO TM) fastener in the Kintner patent, the snap in the Berman patent, and the common zipper. Of these the hook-and-loop, the snap and the zipper do not stand up well under repeated laundering/drying cycles and they have a short useful life. Moreover, the hook-and-loop and the zipper are irritating on prolonged contact with the skin and the zipper is cold to the touch. The double button is a comparatively rare item that presents no obvious advantage over the common sewed on button for this application.

In a second embodiment of the invention, which is an adaptation for waterbeds, the bottom bedsheet is rectangular and is provided with four corner pockets—each a right isosceles triangle, about 18 inches on each side—sewn to the edges of the bedsheet. The pockets are adapted to receive and retain the corresponding four corners of the mattress. Such bedsheets are commonly used on waterbeds. When stretched in position on the mattress, the seam of the pocket reaches down about midway between the top- and bottom-perimeters of the mattress at the very corner and climbs therefrom steeply toward the top perimeter of the mattress.

One component of the improvement of this invention is the provision of a plurality of four or more equally-spaced buttons along the central segment of the foot end hem of the bottom bedsheet, which segment extends between the two triangular pockets, that is, about 18 inches inboard from each corner of the bedsheet. No button is provided in the corner because of its inaccessibility for servicing the bedding.

The top bedsheet of this embodiment of the invention is likewise rectangular in shape and is provided in its foot end hem with a plurality of buttonholes equal in number to the above plurality of buttons and appropriately disposed so as to engage and retain each corresponding button of the bottom bedsheet.

Corner pockets, now widely used on waterbeds, were taught in the Budinquest and in the Hester patents, both already cited herein. On waterbeds, this construction provides the stability against horizontal slip and against vertical liftoff that is required for the practice of this invention.

In both embodiments of the invention it is preferable to provide an appropriate length of reinforcing tape through which the plurality of buttons is sewn to the foot end of the bottom bedsheet. In the case of the isolated side button of the first embodiment, a reinforcing tab is provided for the same purpose.

It is an object of the invention to provide draft-free foot pocket capability in the top bedsheet which is non-binding to the feet of a sleeper.

It is another object of the invention to provide foot pocket capability which will accommodate the feet of an occupant in any sleeping position and regardless of the size of the person, including one whose feet may extend beyond the foot end of the mattress.

It is still another object of the invention to provide stability of the bedding from horizontal slippage and from vertical liftoff without adding to the discomfort of the sleeper or to the inconvenience of the housekeeper.

These and other objectives are achieved in the improved combination of top- and bottom-bedsheets described herein.

DETAILED DESCRIPTION AND DISCUSSION

Figure 1:
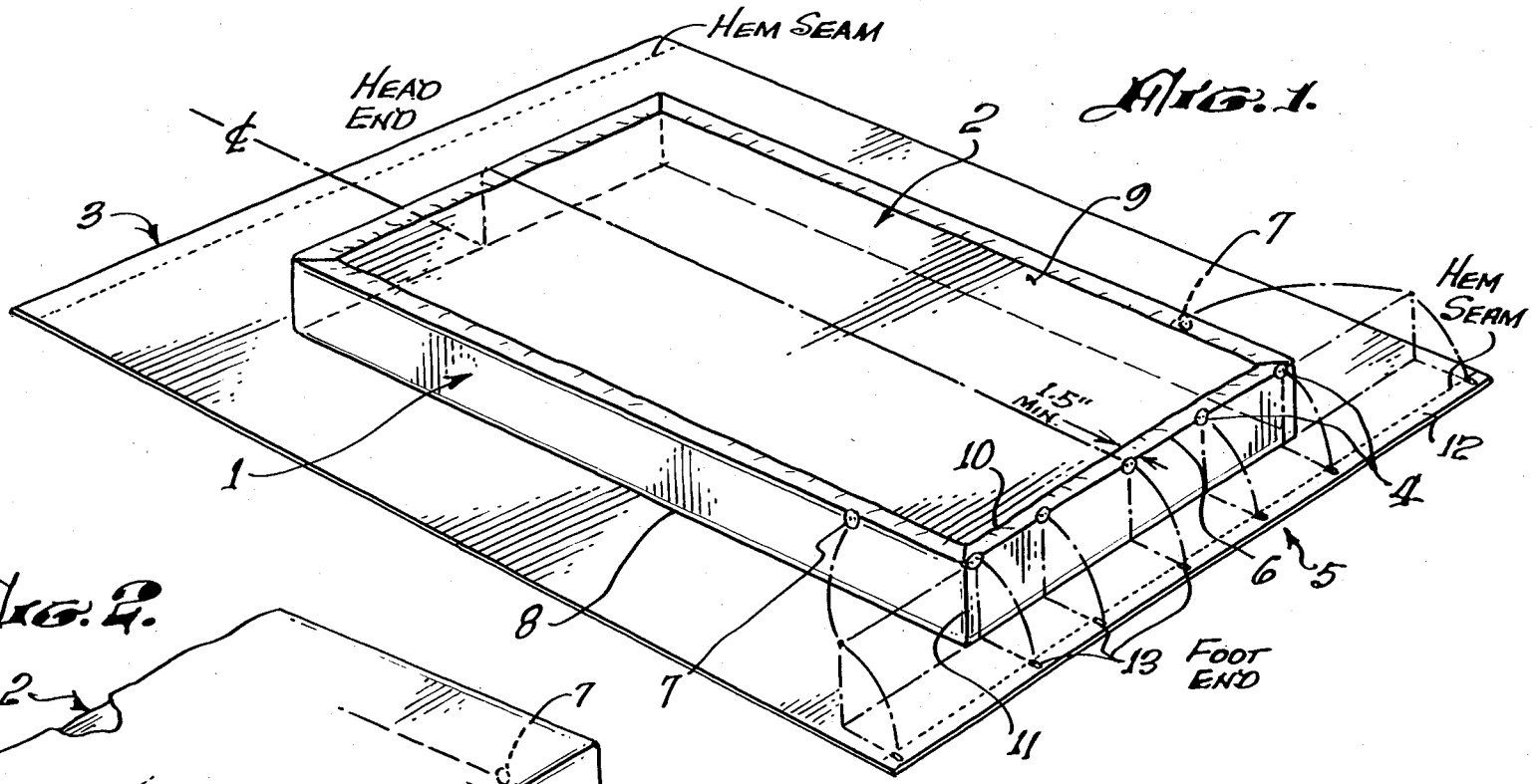
FIG. 1 is a view in inverted perspective of the combination of this invention showing the top bedsheet laid out flat; longitudinally centered over this bedsheet is shown the mattress with the fitted bottom bedsheet stretched thereover and quarter-circle construction lines interconnecting each button with its cooperating buttonhole.
Figure 2:
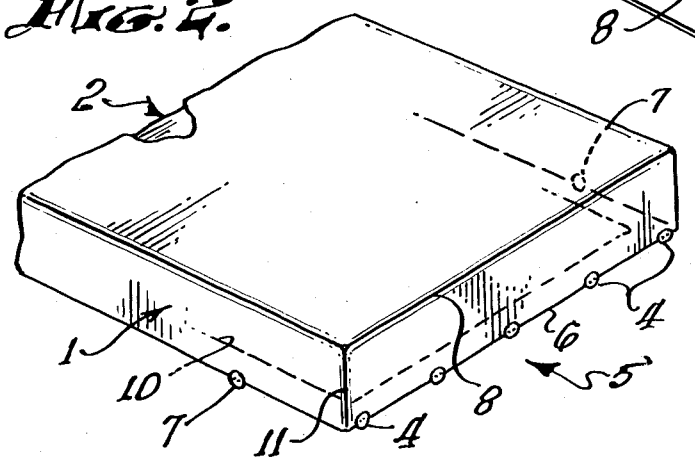
FIG. 2 is a partial view in erect perspective view of the combination of FIG. 1 but omitting the top bedsheet.

As best seen in FIG. 1, a fitted bottom bedsheet, generally indicated as (1) is snugly stretched over a mattress, generally indicated as (2), which in turn engages a top bedsheet, generally indicated as (3), by means of a plurality of equally-spaced buttons (4) sewed to bottom bedsheet 1 along the foot end, generally indicated as (5), of the bottom perimeter edge (6) of the mattress. There is one additional button (7) sewed to each side of the bottom bedsheet, likewise in alignment with the bottom perimeter edge 6. The fitted bottom bedsheet reaches around the top perimeter edge (8) of the mattress, thence around the bottom perimeter edge 6, and thence extends inwardly along the bottom (9) of the mattress to terminate in a free edge (10) at least about 1½ inches inboard from the bottom perimeter edge 6.

The free edge 10 defines a rectangle of 4 free edges, hereinafter distinguished from each other by the terms: two "side free edges", the "head end free edge" and the "foot end free edge". As already mentioned, at least two free edges on opposite sides are elasticized, for the convenience of the housewife in stretch the bedsheet over the mattress, but preferably, all four free edges are elasticized as shown in FIG. 1.

The buttons 4 are equally spaced along a central segment of the bottom perimeter edge 6, which terminates about 1 inch inboard from each corner seam (11). These buttons are spaced from about 8 to about 10 inches apart. The plurality of buttons 4 is at least 3, but preferably is 5. The additional side button 7 on each side, also aligned with the bottom perimeter edge 6, is spaced about 12 inches from the corner seam 11.

The top bedsheet 3, rectangular in shape, is provided in its foot end hem (12) with a plurality of buttonholes (13), equal in number to the plurality of buttons in the foot end of bottom perimeter edge 6 plus the two side buttons 7. Each buttonhole 13 is appropriately disposed to engage and to retain its corresponding button 4 or 7. Preferably a length of reinforcing tape, (20) is provided on the opposite side of the bottom bedsheet through which the buttons 4 are sewn and, similarly, a reinforcing tab, 20, is provided through which each side button 7 is sewn.

Figure 1A:
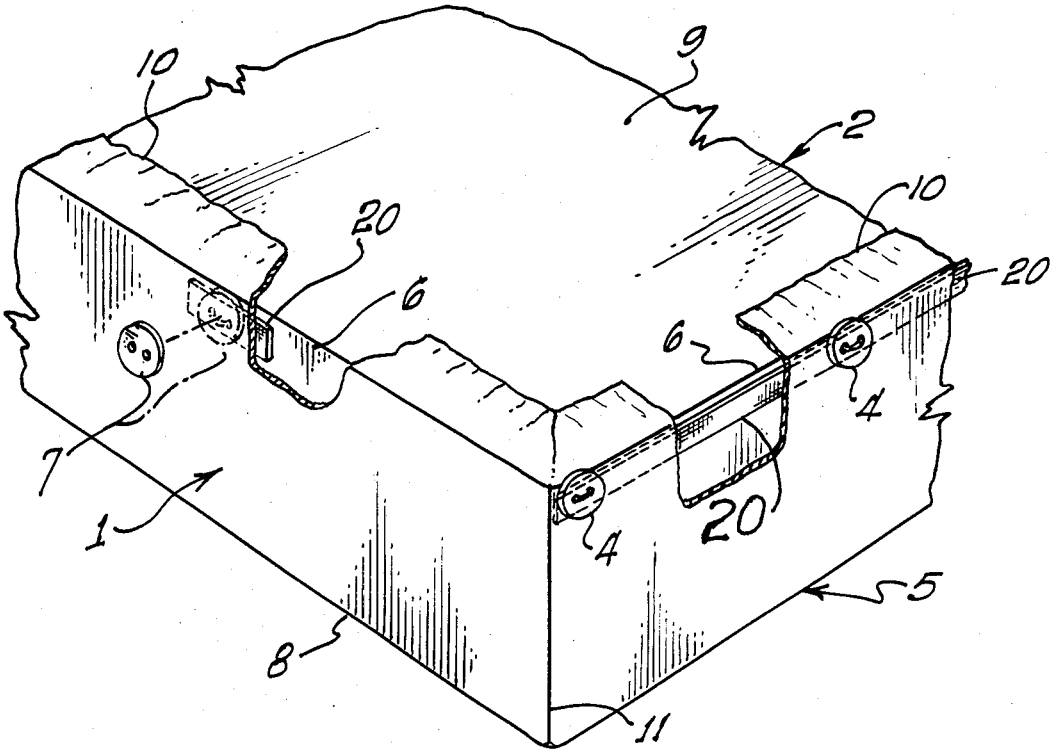
FIG. 1A is an enlargement of a portion of FIG. 1 with portions of the bottom bedsheet 1 broken away.
Figure 3:
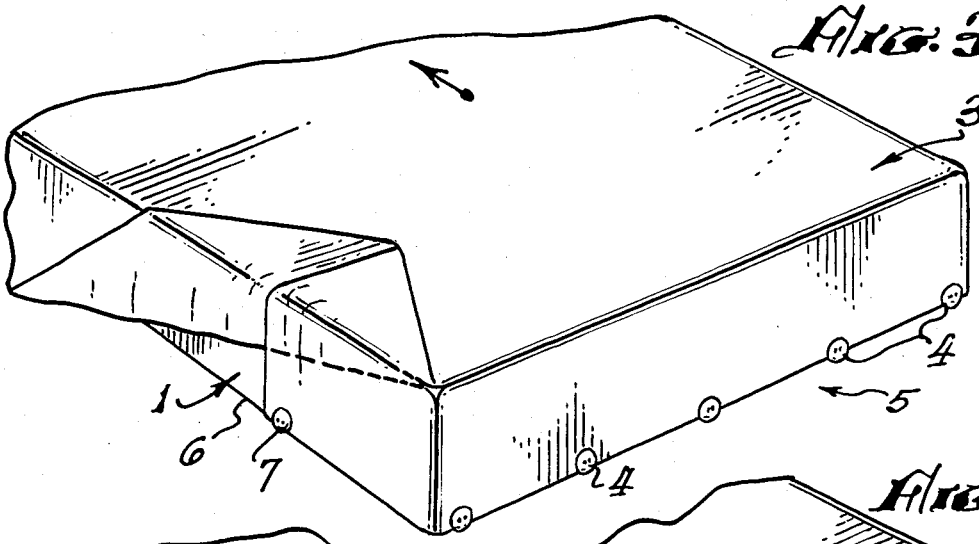
FIG. 3 is similar to FIG. 2 except that the top bedsheet has been included to illustrate the appearance when the top bedsheet is drawn up tightly, as far as possible toward the headboard, and the tucked-in corner is shown folded back over the top to reveal its buttonhole engagement of the side button.
Figure 4:
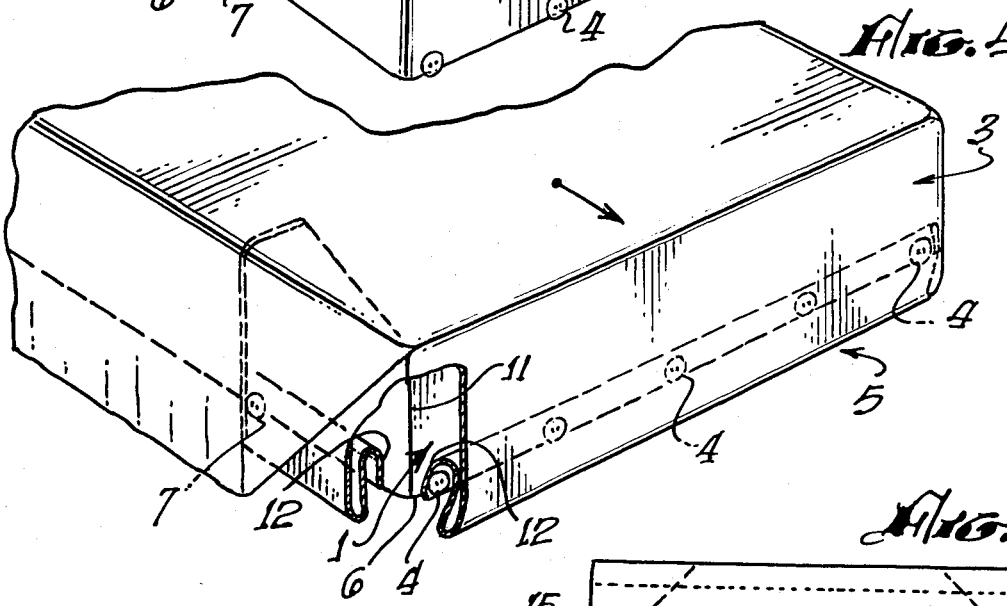
FIG. 4 is similar to FIG. 3 and illustrates the draped loop condition at the foot end with the corner broken away to reveal the interior in the situation where the loop bedsheet is drawn down toward the foot board to accommodate the feet of a taller individual.

FIG. 1A is an enlargement of a portion of FIG. 1 with a first portion of the bottom bedsheet 1 broken away between two adjacent buttons 4 at the foot end 5 so as to expose strip of reinforcing tape 20 as being sandwiched between the mattress 2 and the bottom bedsheet 1 with bottoms 4 sewn through bedsheet 1 and strip 20. A second portion of the bottom bedsheet 1 is broken away adjacent to button 7 to expose a tab (short length) of reinforcing tape 20 sandwiched between the mattress 2 and the bottom bedsheet 1, with the button 7 being sewn through bedsheet 1 and tape 20. Button 7 is shown in exploded view to emphasize that it is outside of bottom bedsheet 1 while the tape 20 is inside thereof.

Figure 5:
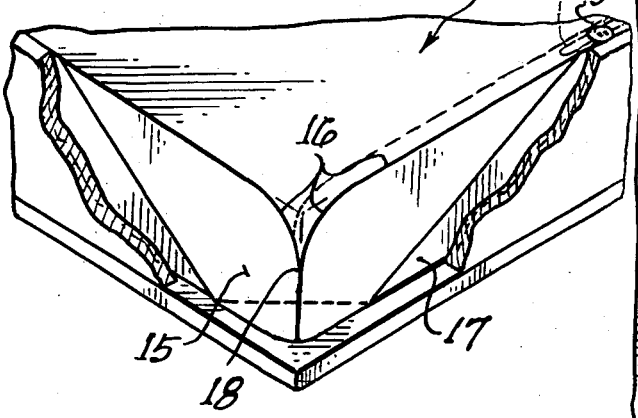
FIG. 5 is a partial view in perspective of one foot end corner of the waterbed embodiment of the invention except with the top bedsheet omitted and with the corner of the bedframe broken away to reveal the appearance of a triangular pocket of the bottom bedsheet reaching around and under the corner of the mattress and to show one button of the plurality of four at the foot end.
Figure 6:
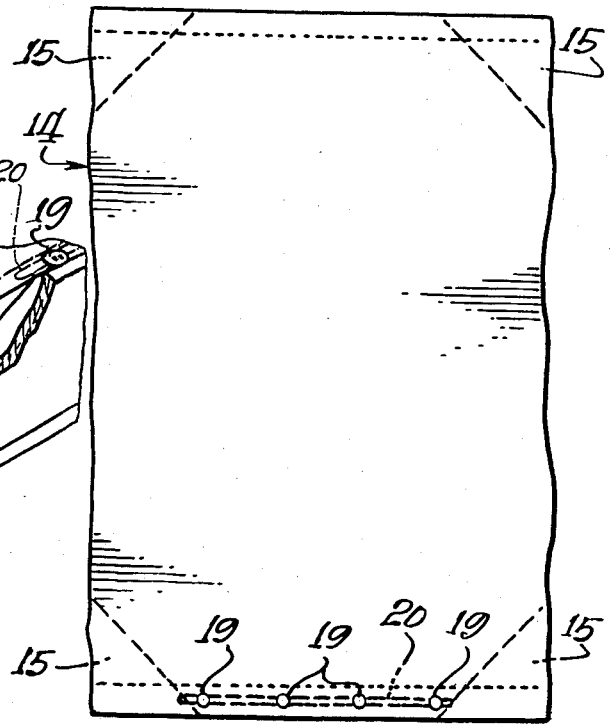
FIG. 6 is a plan view of the rectangular bottom bedsheet showing the disposition of the four corner pockets and of the buttons.

In a second embodiment of the invention which is adapted for waterbeds, a rectangular bottom bedsheet, generally indicated as (14), best seen in FIG. 6, is provided with four triangular pockets (15), each of which is a right isosceles (45°) triangle measuring about 18 inches on each side and sewn to the edges of the bedsheet at corner seams (16). These pockets are adapted to scoop and to contain the corresponding four corners of the mattress (17). As shown in FIG. 5, the tension on the pocket 15 results in pulling down the corner seam 16, so that, in the very corner of the waterbed frame, the corner seam 16 dips sharply to a point (18) intermediate of the top- and the bottom-perimeter edges, usually about midway therebetween.

A plurality of a least four equally-spaced buttons (19) is sewn through a central segment of the foot end hem of the bottom bedsheet 14. This central segment extends across the space between the two pockets 15 at the foot end, that is, between two points spaced about 18 inches inboard from point 18 of each foot end corner pocket 15. Preferably, a length of reinforcing tape (20) is applied to the central segment of the foot end hem in opposition to the buttons 19 and the buttons are sewn through it.

The top bedsheet, not shown, of the second embodiment is the same as in the first embodiment with a minor exception, that is, there are fewer buttonholes in the foot end hem. Specifically, there are no buttonholes corresponding to the side buttons 7 and no buttonholes corresponding to the terminal button 4 in each of the two corners. Moreover, in the second embodiment, the buttons and the buttonholes are more closely spaced, that is, from about 5 to about 7 inches apart.

SUMMARY AND CONCLUSION

The essential elements of the invention are:

1—A buttoned combination of two separable main parts: the top- and the bottom-bedsheet.

2—The bottom bedsheet is fitted to the mattress, reaching around the top perimeter, then around the bottom perimeter, thence extending inwardly along the bottom of the mattress for a distance of at least 1½ inches and there terminating in a rectangle of four free edges, at least two of which are elasticized.

3—The bottom bedsheet is provided, in alignment with the bottom perimeter edge, with a plurality of three or more equally-spaced buttons, preferably a plurality of five buttons, along the foot end. A length of reinforcing tape may be placed in opposition to the line of these buttons through which tape the buttons are then sewn.

4—One additional button is positioned on each side of the bottom bedsheet in alignment with the bottom perimeter edge and spaced about 12 inches from each foot end corner. A reinforcing tab may be placed in opposition to the button and the button then sewn therethrough.

5—The top bedsheet is a rectangular plane with a hem at the foot end. A plurality of buttonholes, equal in number to the plurality of buttons in the foot end of the bottom bedsheet is provided in this hem plus one additional buttonhole for each of the two side buttons, each buttonhole being appropriately disposed so as to engage and retain its corresponding button of the bottom bedsheet.

6—The buttoned combination provides stability against horizontal slippage and against vertical liftoff of the bedding.

7—The buttoned combination provides sufficient longitudinal freedom in the top bedsheet and thereby a pocket which is draft-free and non-confining to the feet of a sleeper, regardless of size, including one whose feet may exend beyond the foot end, and regardless of the sleeper's kicking and tossing movements.

8—In the waterbed embodiment of the invention the main difference resides in the bottom bedsheet construction which can only be anchored to the four corners rather than to the entire perimeter of the regular mattress. Fewer buttons are needed in this embodiment and they are more closely spaced.

The cited prior art has already been discussed. The closest approximation of the present invention appears to be a hypothetical combination of the bottom bedsheet of Black or Hester taken with McHorter (top bedsheet only cut free from the integral bottom bedsheet) and with the button crib frame of Budinquest.

There is no teaching in that hypothetical combination of a foot pocket capability that can accommodate sleepers regardless of size or sleeping position and without irritating the feet; there is no consideration of foot comfort and no teaching of a criticality in the disposition of the buttons.

I claim:

1. In the combination of a top bedsheet and a bottom bedsheet, wherein said bottom bedsheet is adapted to fit and to reach around the bottom perimeter edge of the sides, the head end and the foot end of a mattress, the improvement consisting of providing on said bottom bedsheet;

(a) a row of a plurality of buttons distributed in alignment with said bottom perimeter edge along said foot end and one additional button on each side, spaced about 12 inches from said foot end and aligned with said bottom perimeter edge;

(b) said buttons also being spaced about one and one-half inches from the free edge of said foot end and of each side, respectively, of said bottom bedsheet, (c) a reinforcing strip sewn in said foot end of said bottom bedsheet in alignment with and in opposition to said plurality of buttons, and one reinforcing tab sewn on each side in opposition to each said additional button, and (d) providing in said top bedsheet foot end a hem and in said hem a row of buttonholes suitably disposed to receive corresponding buttons in said row of buttons in said bottom bedsheet, including said additional button on each side, whereby said top bedsheet is secured to said bottom bedsheet which is fitted to said mattress.

2. The combination of a top bedsheet and a bottom bedsheet according to claim 1, wherein said plurality of buttons distributed along said foot end is a least three.

3. The combination of a top bedsheet and a bottom bedsheet according to claim 2, wherein said plurality of buttons distributed along said foot end is five.

4. The combination of a top bedsheet and a bottom bedsheet according to claim 2, wherein said plurality of buttons distributed along said foot end are uniformly spaced from about eight to about 10 inches apart.

* * * * *